United States Patent [19]

Schmidt et al.

[11] Patent Number: 4,823,768

[45] Date of Patent: Apr. 25, 1989

[54] RADIANT HEATER

[76] Inventors: Gerhard Schmidt, 5325-93 Street, Edmonton, Alberta, Canada, T6E 5R4; Heinz Schmidt, AM Burgfeld 32, 5042 Erftstadt Lechenich, Fed. Rep. of Germany

[21] Appl. No.: 122,383

[22] Filed: Nov. 19, 1987

[51] Int. Cl.[4] ..... F24C 3/00

[52] U.S. Cl. ..... 126/91 R; 237/70

[58] Field of Search ..... 126/92 B, 91 R; 237/70; 432/222, 223

[56] References Cited

U.S. PATENT DOCUMENTS

| | | | |
|---|---|---|---|
| 1,492,135 | 4/1924 | Lewis et al. . | |
| 1,900,570 | 3/1933 | Leiman . | |
| 2,287,246 | 6/1942 | Hess | 158/99 |
| 2,570,554 | 10/1951 | Henwood | 158/99 |
| 2,935,127 | 5/1960 | Stalego | 158/99 |
| 3,115,924 | 12/1963 | Massier | 158/73 |
| 3,162,238 | 12/1964 | Claywell et al. | 158/99 |
| 3,262,484 | 7/1966 | Hess | 158/7.6 |
| 3,279,455 | 10/1966 | Corey | 126/92 |
| 3,302,683 | 2/1967 | Kemp . | |
| 3,703,895 | 11/1972 | Wilberg | 126/85 B |
| 3,763,847 | 10/1973 | Guzdar et al. | 126/92 B |
| 3,946,719 | 3/1976 | Bark et al. | 126/91 A |
| 4,200,085 | 4/1980 | Buehl | 126/9 B |
| 4,354,479 | 10/1982 | Haruhara | 126/92 |
| 4,364,724 | 12/1982 | Alpkvist | 431/11 |
| 4,488,865 | 12/1984 | Davis | 431/1 |

FOREIGN PATENT DOCUMENTS

| | | | |
|---|---|---|---|
| 1401756 | 2/1969 | Fed. Rep. of Germany | 431/ |
| 2358187 | 5/1975 | Fed. Rep. of Germany | 431/ |
| 836709 | 10/1938 | France | 5/3 |
| 7506818 | 12/1975 | Netherlands . | |
| 207242 | 11/1923 | United Kingdom . | |
| 2062209A | 5/1981 | United Kingdom . | |

*Primary Examiner*—Henry A. Bennet

*Attorney, Agent, or Firm*—Marjama & Pincelli

[57] ABSTRACT

The present invention provides a high output radiant heater which uses a heat exchanger to obtain a variety of types of heat from a single power source. The heater is comprised of a housing; a combustion chamber in the housing, the combustion chamber defining a central axis and having an intake end having an intake opening thereat and an exhaust end having a discharge opening thereat, the chamber defining a flow passage for products of combustion along the central axis; a heat exchange chamber surrounding the intake end of the combustion chamber; a heat exchanger disposed within the heat exchange chamber; radiator means defining the exhaust end of the combustion chamber for radiating heat radially outwardly of the exhaust end of the combustion chamber, the radiator having a plurality of fluid flow passages disposed in planes containing the central axis, each of the passages having an inlet end communicating with the combustion chamber and an outlet end opening into the heat exchange chamber, whereby products of combustion enter the passage inlets and flow therealong and into the heat exchange chamber; and reflector means surrounding the radiator means for reflecting axially outwardly of the housing heat radiated by the radiator means.

11 Claims, 4 Drawing Sheets

RADIANT HEATER

BACKGROUND OF THE INVENTION

The criterion for evaluating a radiant heater are output, efficiency and versatility. Output is important, as in applications such as soil sterilization the sterilization will not occur unless specified heat levels are attained. Efficiency is important as fuel costs may determine whether use of the heater for a specific application is economically viable. Versatility is important as heating requirements from industry to industry, or even within a single industry, vary with the application.

SUMMARY OF THE INVENTION

The primary object of the present invention is to provide an improved radiant heater.

Broadly, the present invention provides a radiant heater which is comprised of a housing; a combustion chamber in the housing, the combustion chamber defining a central axis and having an intake end having an intake opening thereat and an exhaust end having a discharge opening thereat, the chamber defining a flow passage for products of combustion along the central axis; a heat exchange chamber surrounding the intake end of the combustion chamber; a heat exchanger disposed within the heat exchange chamber; radiator means defining the exhaust end of the combustion chamber for radiating heat radially outwardly of the exhaust end of the combustion chamber, the radiator means having a plurality of fluid flow passages disposed in planes containing the central axis, each of the passages having an inlet end communicating with the combustion chamber and an outlet end opening into the heat exchange chamber, whereby products of combustion enter the passage inlets and flow therealong and into the heat exchange chamber; and reflector means surrounding the radiator means for reflecting axially outwardly of the housing heat radiated by the radiator means.

BRIEF DESCRIPTION OF THE DRAWINGS

These and other features of the invention will become more apparent from the following description in which reference is made to the appended drawings, wherein.

DETAILED DESCRIPTION OF THE INVENTION

Figure 1:
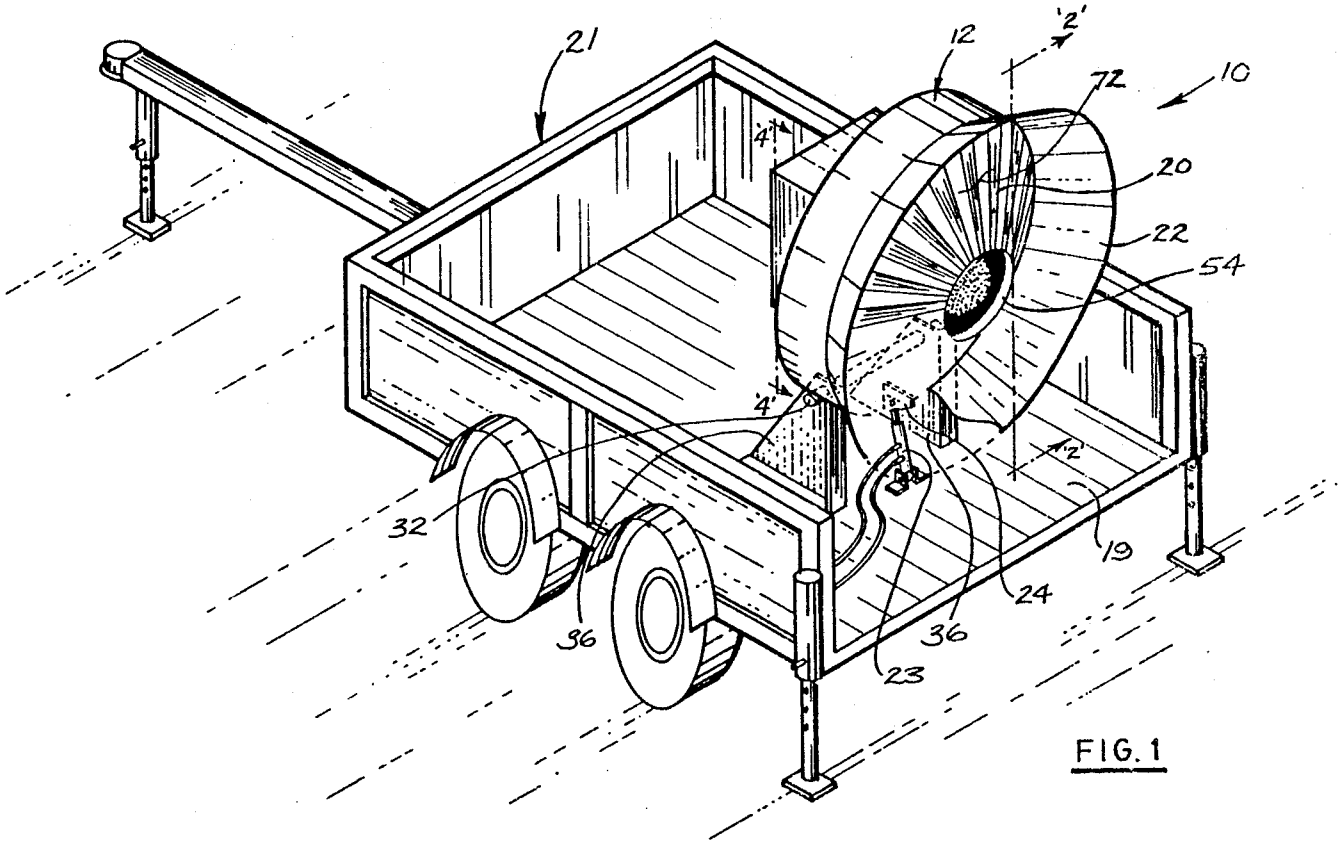
FIG. 1 is a perspective view of a preferred embodiment of the invention.
Figure 2:
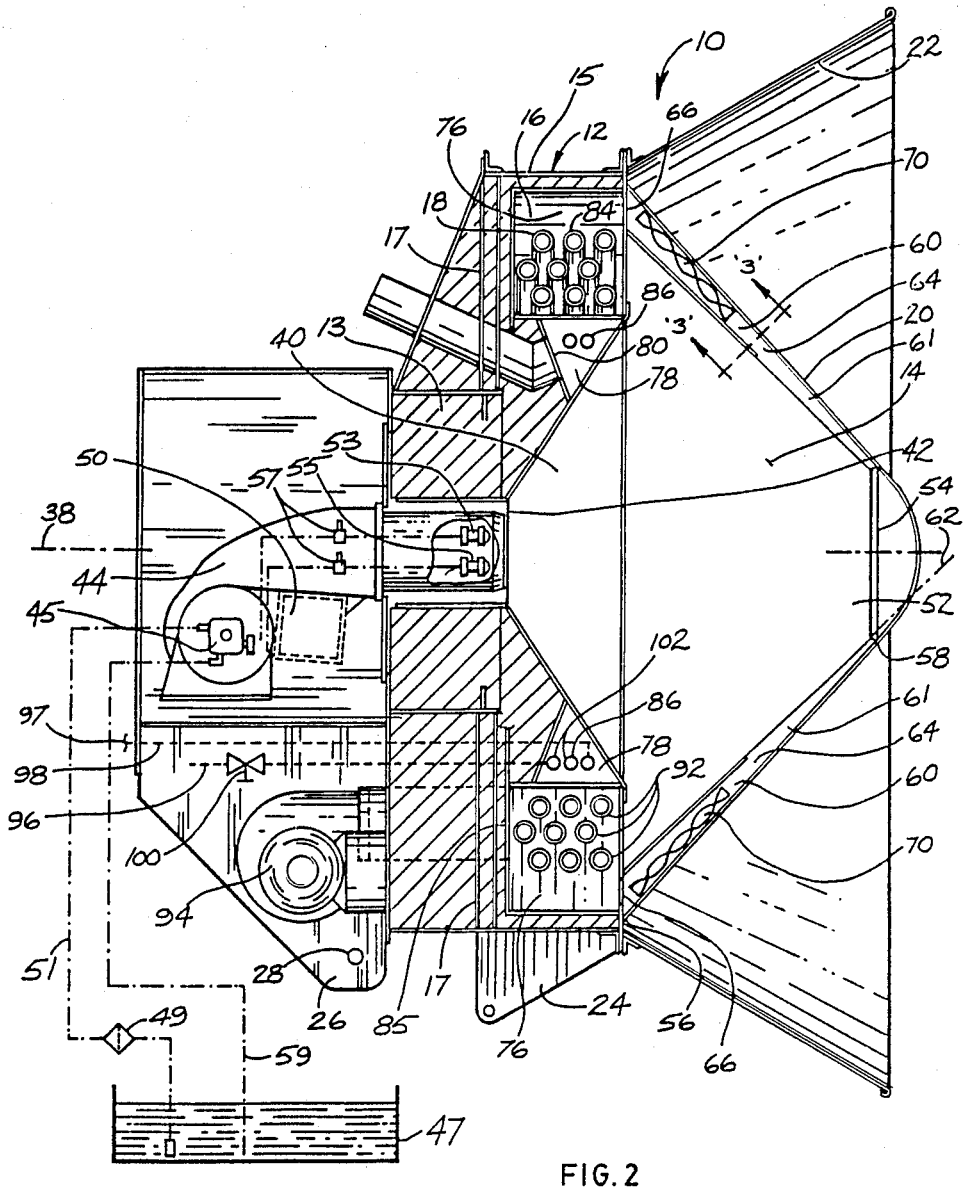
FIG. 2 is a sectional view of a preferred embodiment of the invention taken at section line 2—2 of FIG. 1.
Figure 4:
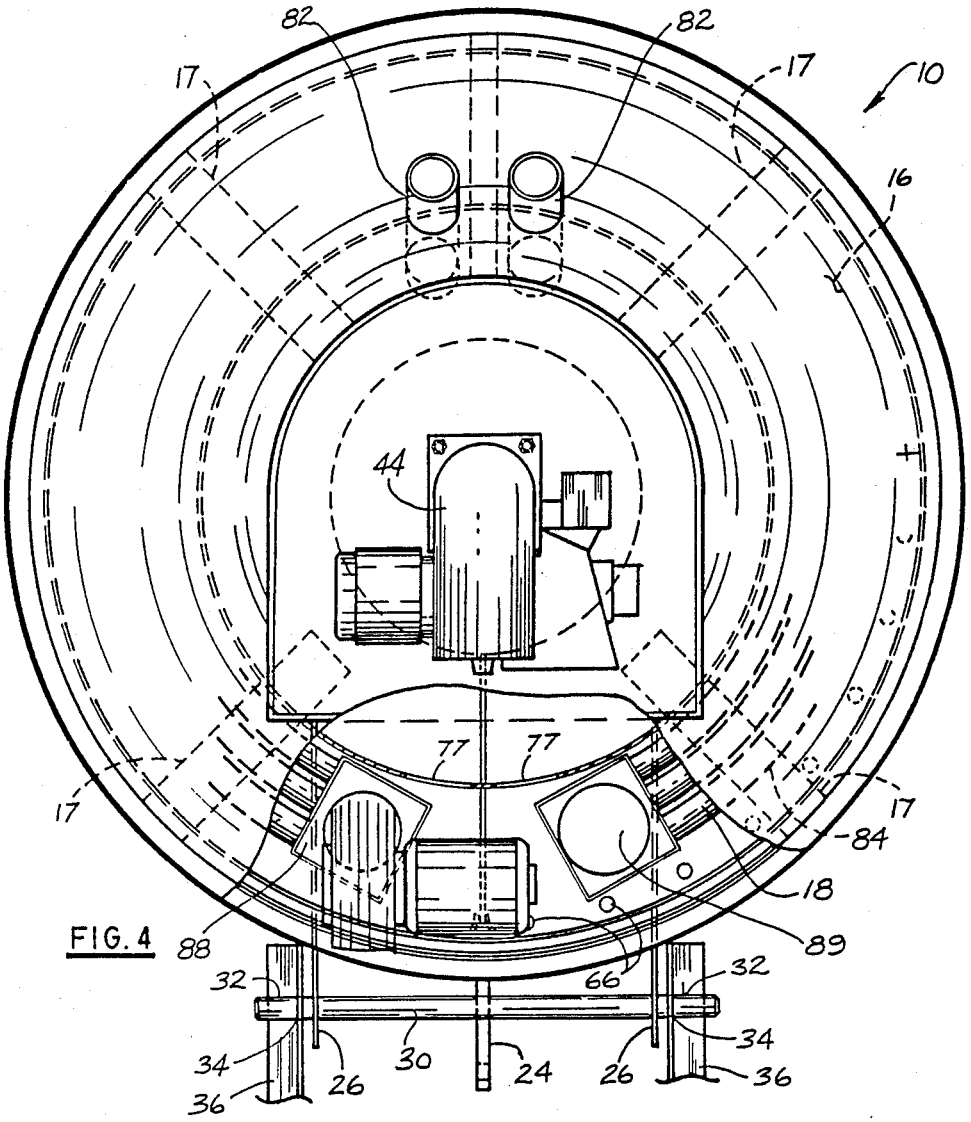
FIG. 4 is a section view of a preferred embodiment of the invention taken at section line 4—4 of FIG. 1.

The preferred embodiment of the invention, is a radiant heater generally designated by reference numeral 10, which is illustrated in and will now be described with reference to FIGS. 1 through 5.

The primary components of radiant heater 10 are, a housing 12, a combustion chamber 14, a heat exchange chamber 16, a heat exchanger 18, a radiator 20 and a reflector 22.

Housing 12 is generally cylindrical in cross-section, having a central core portion 13, and an outer circumference portion 15, which are secured in relative position by a plurality of struts 17 which are welded to portions 13 and 15. Attached to housing 12 are front and rear mounting brackets 24 and 26. Rear mounting brackets 24 has apertures 28 which are adapted to receive a fixed shaft 30. The ends 32 of fixed shaft 30 are received in apertures 34 of supports 36, in order that housing 12 may be mounted in factory premises or on a platform 19 of a trailer 21 as illustrated in FIG. 1. Front mounting bracket 26 is adapted to be connected to hydraulic mounts 23 on platform 19, in order that the central axis 38 of radiant heater 10 may be adjusted vertically. Radiant heater 10 is not capable of lateral adjustment, other than through relative positioning of platform 19 upon which heater 10 is mounted.

Combustion chamber 14 is disposed within housing 12, and defines central axis 38. Combustion chamber 14 has an intake end 40 having an intake opening 42 thereat. Positioned at intake opening 42 is a gas burner 44. Combustion air is provided to burner 44 through fresh air inlet 46, which is connected by air duct 48 to end 50 of burner 44. Combustion chamber 14 has an exhaust end 52 having a discharge opening 54 thereat. Combustion chamber 14 defines a flow passage for products of combustion along central axis 38. Intake end 40 of combustion chamber 14 progressively increases in size about central axis 38 from intake opening 42 towards discharge opening 54. Exhaust end 52 of combustion chamber 14 progressively decreases in size from intake end 40 to discharge opening 54 of combustion chamber 14.

Burner 44 has a fuel pump 45 which draws fuel from fuel tank 47 through filter 49 and fuel suction line 51. Burner 44 is a two stage burner and has a first stage nozzle 53 and a second stage nozzle 55. The flow of fuel from fuel pump 45 to nozzles 53 and 55 are controlled by solenoid valves 57, which open to permit the passage of fuel at 34 second intervals. Should the air fuel mixture fail to ignite, solenoid valves 57 remain closed in order to prevent an excess of fuel from being pumped into burner 44. Excess fuel is returned to fuel tank 47 through fuel return line 59. The presence of solenoid valves 57 and fuel return line 59 are safety features to prevent the possibility of explosions. Burner 44 can be adapted for operation on any of a number of fuels, such as propane, natural gas, diesel fuel, kerosene, and the like.

Figure 3:
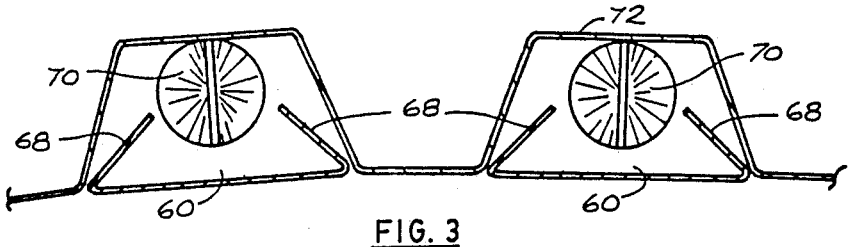
FIG. 3 is a sectional view of a portion of a preferred embodiment of the invention taken at section line 3—3 of FIG. 2.
Figure 5:
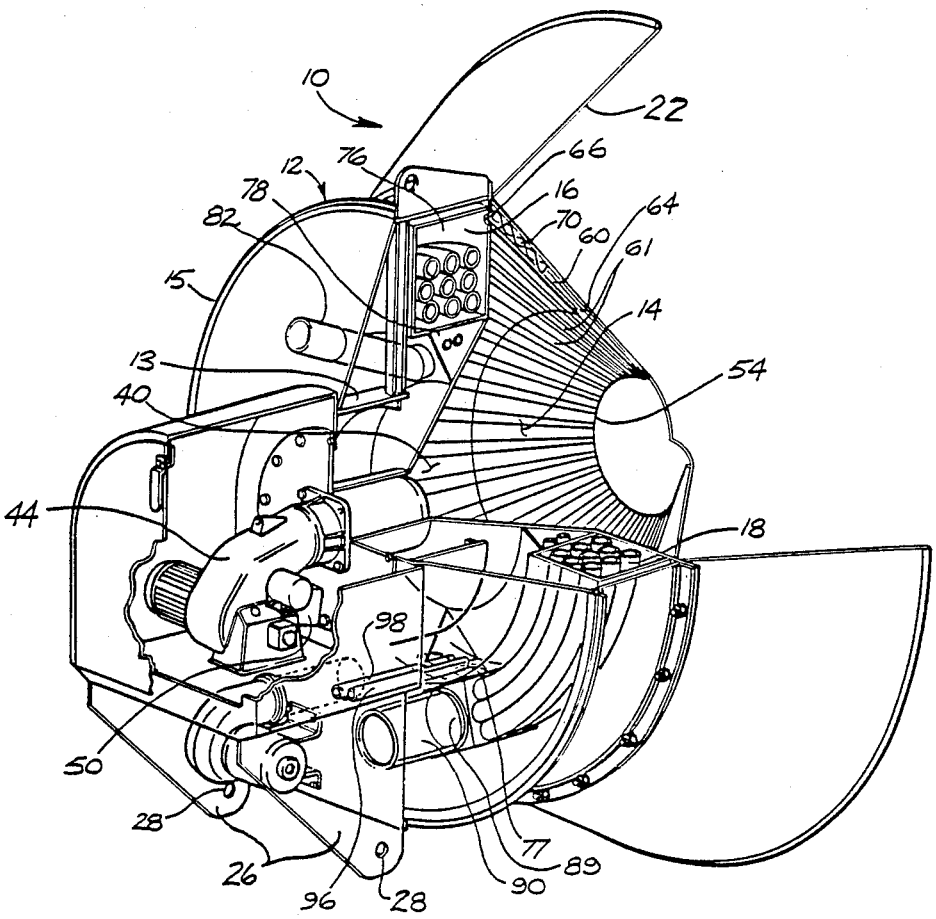
FIG. 5 is a cut away view of a preferred embodiment of the invention.

Radiator 20 is in the form of a corrugated conical shell having a larger end 56 concentrically disposed about axis 38 and adjacent intake end 40 of combustion chamber 14, and a smaller end 58 concentrically disposed about axis 38. Radiator 20 defines exhaust end 52 of combustion chamber 14 and serves to radiate heat radially outwardly of exhaust end 52 of combustion chamber 14. Radiator 20 has a plurality of corrugations 61 disposed in planes 62 containing central axis 38. Corrugations 61 are open with the exception of an 18 inch portion remote from smaller end 58, which is enclosed forming fluid flow passages 60. Passages 60 have an inlet end opening 64 communicating with combustion chamber 14 and an outlet end 66 remote communicating with heat exchange chamber 16. Products of combustion from combustion chamber 14 flow from smaller end 58 of conical radiator 20, along open corrugations 61 eventually entering passage inlets 64 of passages 60, through outlets 66 and into heat exchange chamber 16. In order that the flow of exhaust gases from inlet end 64 to outlet end 66 may be retarded to retain heat within radiator 20 baffle partitions 68 and a spiral baffle 70 are disposed in passages 60, as is illustrated in FIG. 3.

Conical radiator 20 has an irregular exterior surface 72, which can be attributed to the presence of corrugations 61, which are present on both the interior and exterior surfaces. Corrugations 61 serve to provide a greater surface area for the radiation of heat. Reflector 22 surrounds radiator 20 for reflecting axially outwardly of housing 12 heat radiated by radiator 20. Radiator 20 is made out of materials which are known by the trade name "Ferrotherm 4816". Ferrotherm 4816 was originally developed for use in atomic reactors, and has a composition which includes 79.9% nickel and 0.29% titanium for resistance to temperature, and 1.2% aluminum for flexibility. The surface of reflector 22 is subjected to a treatment which is described by Krupp Industries of Germany as being "glo-heated". The applicant has attempted to obtain further particulars of this treatment for the purpose of making a full and complete disclosure, and has been advised that the treatment is a trade secret of Krupp Industries.

Heat exchange chamber 16 surrounds intake end 40 of combustion chamber 14. Heat exchange chamber 16 has two annular rings, a collector ring 76 and an exhaust ring 78. Collector ring 76 communicates with outlet end 66 of each of passages 60. Exhaust ring 78 has an opening 80 which is connected to exhaust duct 82. There are two openings 77, which permit communication of exhaust gases between collector ring 76 and exhaust ring 78. Exhaust ring 78 is smaller in size than collector ring 76 as the air has cooled down and contracted somewhat by the time it reaches exhaust ring 78.

A heat exhanger 18 is disposed within heat exchange chamber 16. Heat exchanger 18 is comprised of two of pipes, 84 and 86, configured in coils. Pipe 84 is positioned in collector ring 76. Pipe 84 is connected at one end 85 to cold air intake duct 88 and at the opposite end 89 to hot air outlet duct 90. Pipe 84 is formed into nine coils 92 within collector ring 76. An air blower 94 is connected to cold air intake duct 88 at end 85 of pipe 84 to blow ambient air through pipe 84. As air circulates within coils 92 of pipe 84, the air becomes heated by the products of combustion in collector ring 76. End 89 of pipe 84 is adapted to be connected to the duct work of a hot air heating system (not shown). Pipe 86 is positioned in exhaust ring 78. Pipe 86 is connected at one end 95 to cold water intake duct 96 and at the opposite end 97 to hot water outlet duct 98. Cold water intake duct 96 is adapted to be connected to a water source (not shown). A manual control valve 100 is placed at end 95 of pipe 86 to control water flow. Pipe 86 is formed into three coils 102, within exhaust ring 78. As water circulates through coils 102 of pipe 86, the water becomes heated by the products of combustion within exhaust ring 78. End 97 of pipe 86 is adapted to be connected to a network of pipes forming a hot water heating system (not shown).

To operate radiant heater 10, burner 44 is connected to fuel tank 47, and air is drawn through fresh air inlet 46 via air duct 48 until the air/fuel mixture is ignited within combustion chamber 14. The products of combustion pass through intake opening 42 at intake end 40 of combustion chamber 14 and move along central axis 38 to discharge opening 54 at discharge end 52 of combustion chamber 14. At discharge end 52 the products of combustion pass through discharge opening 54 into inlet end 64 of passage 60. The movement of the products of combustion along passage 60 is retarded by baffle partitions 68 and a spiral baffle 70 within passages 60. When the products of combustion reach the outlet end 66 of passage 60, the products of combustion are discharged into collector ring 76 of heat exchange chamber 16. The products of combustion then flow around collector ring 76 of heat exchange chamber 16, then into exhaust ring 78 of heat exchange chamber 16, finally being vented out a single exhaust duct 82.

At the same time as the above described combustion cycle is operating, two other heating cycles are operating within heat exchange chamber 16. With one of these cycles, air is blown by blower 94 via cold air inlet duct 88 into pipe 84. Air circulates through coils 92 of pipe 84 until it reaches hot air outlet duct 90. As the air passes through coils 92 of pipe 84 it becomes heated by the products of combustion within collector ring 76. Hot air outlet duct 90 serves a secondary function of preheating the air which enters through fresh air inlet 46 into burner 44. This is accomplished by placing air duct 48 and hot air outlet duct 90 in close proximity such that a partial heat exchange takes place. Preheating the air entering burner 4, assists in combustion, provided the air is not heated to too great an extent. Preheating the air to approximately 50 degrees celsius is viewed as acceptable. Due to the tendency of air to expand when heated, heating the air to too great an extent can create an undesirable back pressure within the system.

With the other of these cycles, water is drawn through cold water intake 96 into pipe 86. As water circulates around coils 102 of pipe 86, the water is heated by the products of combustion within exhaust ring 78. Water flowing from hot water outlet 98, is heated and can either be used as such or can be connected to a hot water heating system (not shown).

The output of heat from radiator 20 is enhanced by corrugations 61 and reflector 22. Corrugations 61 serve to provide a larger surface area for the radiation of heat. Reflector 22 reflects outwardly the heat of radiator 20.

It will be apparent to one skilled in the art that an increased output can be obtained from radiant heater 10 by virtue of baffle partitions 68 and spiral baffle 70 retarding the movement of products of combustion and thereby retaining heat within radiator 20. It will similarly be apparent that a greater efficiency of operation is obtained by preheating air intake into burner 44, and through use of heat exchange chamber 16 and heat exchanger 18 to give other forms of heat from the same fuel source. It will similarly be apparent that radiant heater 10, has increased versatility and adaptability as radiant heat, hot water, or heated air can be supplied as the application demands. It will be apparent to one skilled in the art that radiant heater 10, can be adapted to provide steam heating, by circulating water within heat exchanger 18 until it becomes converted to steam.

Radiator 20 is constructed to be able to withstand temperatures approaching 1500 degrees centigrade. In controlled tests conducted by the Alberta Research Council, the radiant heat produced was between 1150 and 1250 degrees centigrade, and hot air output was 600 cubic feet per minute at a temperature of 680 degrees centigrade.

The embodiments of the invention in which an exclusive property or privilege is claimed are defined as follows:

1. A radiant heater, comprising:

a. a housing;

b. a combustion chamber in said housing, said combustion chamber defining a central axis and having an intake end having an intake opening thereat and an exhaust end and having a discharge opening thereat, said chamber defining a flow passage for products of combustion along said central axis;

c. a heat exchange chamber surrounding said intake end of said combustion chamber;

d. a heat exchanger disposed within said heat exchange chamber, said heat exchanger having a pipe formed into a plurality of coils one end of which is adapted to be connected to means for circulating fluids;

e. radiator means surrounding said combustion chamber, said radiator means defining said exhaust end of said combustion chamber for radiating heat radially outwardly of said exhaust end of said combustion chamber, said radiator means having a plurality of fluid flow passages disposed in planes containing said central axis, each said passage having an inlet end communicating with said combustion chamber and an outlet end opening into said heat exchange chamber, whereby products of combustion enter said passage inlets and flow therealong and into said heat exchange chamber; and f. reflector means surrounding said radiator means for reflecting axially outwardly of said housing heat radiated by said radiator means.

2. A radiant heater as defined in claim 1, said intake portion of said combustion chamber progressively increasing in size about said central axis from said intake opening towards said discharge opening.

3. A radiant heater as defined in claim 1 or 2, said exhaust end of said combustion chamber progressively decreasing in size from said intake end of said combustion chamber to said discharge opening of said combustion chamber.

4. A radiant heater as defined in claim 1, said radiator means being in the form of a corrugated conical shell having a larger end concentrically disposed about said axis and adjacent said intake end of said combustion chamber and a smaller end concentrically disposed about said axis and defining said discharge opening.

5. A radiant heater as defined in claim 4, wherein retarding means are disposed in said passages, whereby the flow of exhuast gases from said inlet end to said outlet end may be retarded to retain heat within said radiator.

6. A radiant heater as defined in claim 5, said retarding means comprising one or more baffle partitions disposed in said passages.

7. A radiant heater as defined in claim 5, having a spiral baffle disposed in said passages.

8. A radiant heater, comprising:

a. a housing;

b. a combustion chamber in said housing, said combustion chamber defining a central axis and having an intake end having an intake opening thereat and an exhaust end having a discharge opening thereat, said chamber defining a flow passage for products of combustion along said central axis, said intake portion of said combustion chamber progressively increasing in size about said central axis from said intake opening towards said discharge opening, said exhaust end of said combustion chamber progressively decreasing in size from said intake end of said combustion chamber to said discharge opening of said combustion chamber;

c. a heat exchange chamber surrounding said intake end of said combustion chamber;

d. a heat exchanger disposed within said heat exchange chamber;

e. a radiator in the form of a conical shell having a larger end concentrically disposed about said axis and adjacent said intake end of said combustion chamber and a smaller end concentrically disposed about said axis and defining said discharge opening, said radiator defining said exhaust end of said combustion chamber for radiating heat radially outwardly of said exhaust end of said combustion chamber, said radiator means having a plurality of fluid flow passages disposed in planes containing said central axis, each said passage having an inlet end communicating with said combustion chamber and an outlet end opening into said heat exchange chambe,r whereby products of combustion enter said passage inlets and flow therealong and into said heat exchange chamber, retarding means are disposed in said passages, whereby the flow of exhaust gases from said inlet end to said outlet end may be retarded to retain heat within said radiator; and f. reflector means surrounding said radiator means for reflecting axially outwardly of said housing heat radiated by said radiator means.

9. A radiant heater as defined in claim 8, said retarding means comprising one or more baffle partitions disposed in said passages.

10. A radiant heater as defined in claim 8, having a spiral baffle disposed in said passages.

11. A radiant heater, comprising:

a. a housing;

b. a combustion chamber in said housing, said combustion chamber defining a central axis and having an intake end having an intake opening thereat and an exhaust end having a discharge opening thereat, said chamber defining a flow passage for products of combustion along said central axis, said intake portion of said combustion chamber progressively increasing in size about said central axis from said intake opening towards said discharge opening, said exhaust end of said combustion chamber progressively decreasing in size from said intake end of said combustion chamber to said discharge opening of said combustion chamber;

c. a heat exchange chamber surrounding said intake end of said combustion chamber;

d. a heat exchanger disposed within said heat exchange chamber;

e. a radiator in the form of a conical shell having a larger end concentrically disposed about said axis and adjcent said intake end of said combustion chamber and a smaller end concentrically disposed about said axis and defining said discharge opening, said radiator defining said exhaust end of said combustion chamber for radiating heat radially outwardly of said exhaust end of said combustion chamber, said radiator means having a plurality of fluid flow passages disposed in planes containing said central axis, each said passage having an inlet end communicating with said combustion chamber and an outlet end opening into said heat exchange chamber, whereby products of combustion enter said passage inlets and flow therealong and into said heat exchange chamber, retarding means comprising one or more baffle partitions and a spiral baffle are disposed in said passages, whereby the flow of exhaust gases from said inlet end to said outlet end may be retarded to retain heat within said radiator; and f. reflector means surrounding said radiator means for reflecting axially outwardly of said housing heat radiated by said radiator means.

* * * * *